United States Patent [19]

Hanson et al.

[11] Patent Number: 4,999,934

[45] Date of Patent: Mar. 19, 1991

[54] DREDGING APPARATUS

[75] Inventors: Raymond A. Hanson; Wayne F. Crockett, both of Spokane, Wash.

[73] Assignee: R. A. Hanson Company, Inc., Spokane, Wash.

[21] Appl. No.: 194,758

[22] Filed: May 17, 1988

Related U.S. Application Data

[63] Continuation-in-part of Ser. No. 52,727, May 18, 1987, abandoned.

[51] Int. Cl.[5] ..... E02F 3/92

[52] U.S. Cl. ..... 37/66; 37/189; 37/191 R; 37/69

[58] Field of Search ..... 37/66, 190, 189, 60, 37/64, 69, 70, 191 R

[56] References Cited

U.S. PATENT DOCUMENTS

| | | | |
|---|---|---|---|
| 285,565 | 1/1883 | Brotherhood | 37/69 |
| 660,956 | 10/1900 | Henderson | 37/66 |
| 720,749 | 2/1903 | Sonderegger | 37/69 |
| 732,538 | 6/1903 | Fulcher | 37/60 |
| 748,804 | 1/1904 | Smyth et al. | 37/60 |
| 758,608 | 3/1904 | Andrew | 37/69 |
| 803,587 | 11/1905 | Hanford | 37/69 |
| 879,345 | 2/1908 | Wilson | 37/73 |
| 1,148,816 | 8/1915 | Alleman | 37/58 |
| 1,228,959 | 6/1917 | Oliver | 299/9 |
| 1,315,228 | 9/1919 | Ludlum et al. | 37/69 X |
| 1,698,033 | 1/1929 | Storsand | 37/60 |
| 1,777,575 | 10/1930 | Penney | 37/60 |
| 3,010,232 | 11/1961 | Skakel et al. | 37/69 X |
| 3,146,537 | 9/1964 | von Bolhar | 37/69 |
| 3,476,498 | 1/1969 | von Bolhar | 37/66 X |
| 3,766,672 | 10/1973 | Hanson et al. | 37/91 |
| 3,828,913 | 8/1974 | Scholler | 37/190 X |
| 3,902,448 | 9/1975 | Davis | 37/73 |
| 3,919,791 | 11/1975 | Smith | 37/67 |
| 4,033,056 | 7/1977 | Demmers | 37/73 |
| 4,058,914 | 11/1977 | Kiss | 37/66 |
| 4,202,119 | 5/1980 | Grace | 37/69 |
| 4,242,814 | 1/1981 | Fluks | 37/66 |
| 4,258,486 | 3/1981 | Barre | 37/190 |
| 4,302,893 | 12/1981 | van den Elshout et al. | 37/66 |
| 4,485,569 | 12/1984 | Matsumae et al. | 37/73 |
| 4,646,449 | 3/1987 | Steinkuhler et al. | 37/66 |
| 4,702,023 | 10/1987 | McDowell | 37/66 |

FOREIGN PATENT DOCUMENTS

| | | | |
|---|---|---|---|
| 495439 | 4/1930 | Fed. Rep. of Germany | 37/192 R |
| 608812 | 2/1934 | Fed. Rep. of Germany | 37/190 |
| 1040329 | 8/1966 | United Kingdom | 37/69 |
| 1383089 | 2/1975 | United Kingdom | 37/72 |

OTHER PUBLICATIONS

Development International Article "Cutter Wheel to Corner Bottom End of the Market?".

O&K Tagebau-und Schiffstechnik Brochure.

*Primary Examiner*—Randolph A. Reese

*Assistant Examiner*—Arlen L. Olsen

*Attorney, Agent, or Firm*—Wells, St. John & Roberts

[57] ABSTRACT

A floating dredge and hydraulic dredging apparatus for mining underwater mineral bearing deposits is disclosed. The dredge includes an overburden excavator and an ore excavator mounted to a pontoon for removing overburden and ore material, respectively. Processors on the pontoon receive material from the excavators. Dredging control components coordinate the operation of the ore and overburden excavators to efficiently remove and mine the desired material.

20 Claims, 9 Drawing Sheets

10
26
22
23
27
24
86
25
73
72
90
70
14
12
18
34
32
31
30
16
68
69
82
80
84

DREDGING APPARATUS

CROSS-REFERENCE TO RELATED APPLICATIONS

This patent is a continuation-in-part of Ser. No. 07/052,727, filed May 18, 1987, which is now abandoned.

TECHNICAL FIELD

This invention relates generally to dredging, and more particularly to hydraulic dredges and the mining of alluvial deposits.

BACKGROUND OF THE INVENTION

A common method of mining alluvial deposits, such as those in and around river beds, is to utilize a floating dredge or pontoon having an excavating device positioned at one end thereof. The excavating device removes material from the bed of the river or other body of water in which it is working, and delivers the material to the pontoon. There it is processed to separate the desired minerals or other pay material from waste material. The waste material is then transported off the pontoon, normally to reclaim the area which has just been dredged.

This method of mining alluvial deposits has been in use for well over one hundred years, as evidenced by U.S. Pat. No. 285,565 to Brotherhood. The Brotherhood patent discloses a floating pontoon having an endless bucket line conveyor for excavating material from underwater and directing it to the pontoon. An endless bucket line is very often used in mining of this type since the dredging is continuous and a high capacity of material is capable of being removed.

Other apparatus and methods of dredging ore utilize a hydraulic suction device or a bucket line type conveyor in combination with a hydraulic suction device. U.S. Pat. No. 1,148,816 to Alleman illustrates the use of a suction device for underwater dredging. The Alleman patent also shows the use of an agitating belt to loosen the dredged material so that it can be received into the suction pipe.

U.S. Pat. No. 748.804 to Smith et al. illustrates the use of a bucket line conveyor and hydraulic suction device in combination. The suction device transports fine material, while the bucket line excavates and transports larger material. The in-feed ends of both dredging systems are adjacent to one another. Both are carried by the same support frame and move in unison with respect to the supporting pontoon.

Some alluvial type deposits have as much as 90 to 100 feet of material above bedrock. Very often, particularly in the case of gold or other heavy metals, most all of the desired minerals are found in the lower 20% or so of the material overlying the bedrock. Accordingly, in a deposit with one hundred feet of total material overlying bedrock, most all of the gold bearing material would be in the lower twenty feet. This leaves a total of eighty feet of overburden material overlying what is commonly referred to as the "pay zone" containing the gold. To get to that pay material, the overburden must first be removed. Accordingly, there is approximately four times the volume of waste overburden material which needs to be removed with respect to the volume of pay material.

Prior art dredging devices, such as those just described, can be used to excavate this large volume of material. However, where the proportion of overburden material to that of the pay material is great, a large amount of waste material is processed by the dredge before ever reaching the pay material. That is, all material is treated identically to extract the desired minerals from the waste material. This means that in the example discussed above, for every cubic yard of pay material processed there are four cubic yards of overburden material also processed. Because of this, a large percentage of the material processing time is wasted in merely cycling overburden material through the processors so that it can be eventually removed from the barge.

It should thus be readily apparent that such prior art devices and methods of dredging are extremely inefficient in excavating deposits having a large amount of overburden material in proportion to underlying pay material. Accordingly, a need remains for improved methods and apparatus which are capable of mining such deposits in an efficient manner.

BRIEF DESCRIPTION OF THE DRAWINGS

The invention is illustrated in the accompanying drawings, in which.

DETAILED DESCRIPTION OF THE PREFERRED EMBODIMENT

Figure 1:
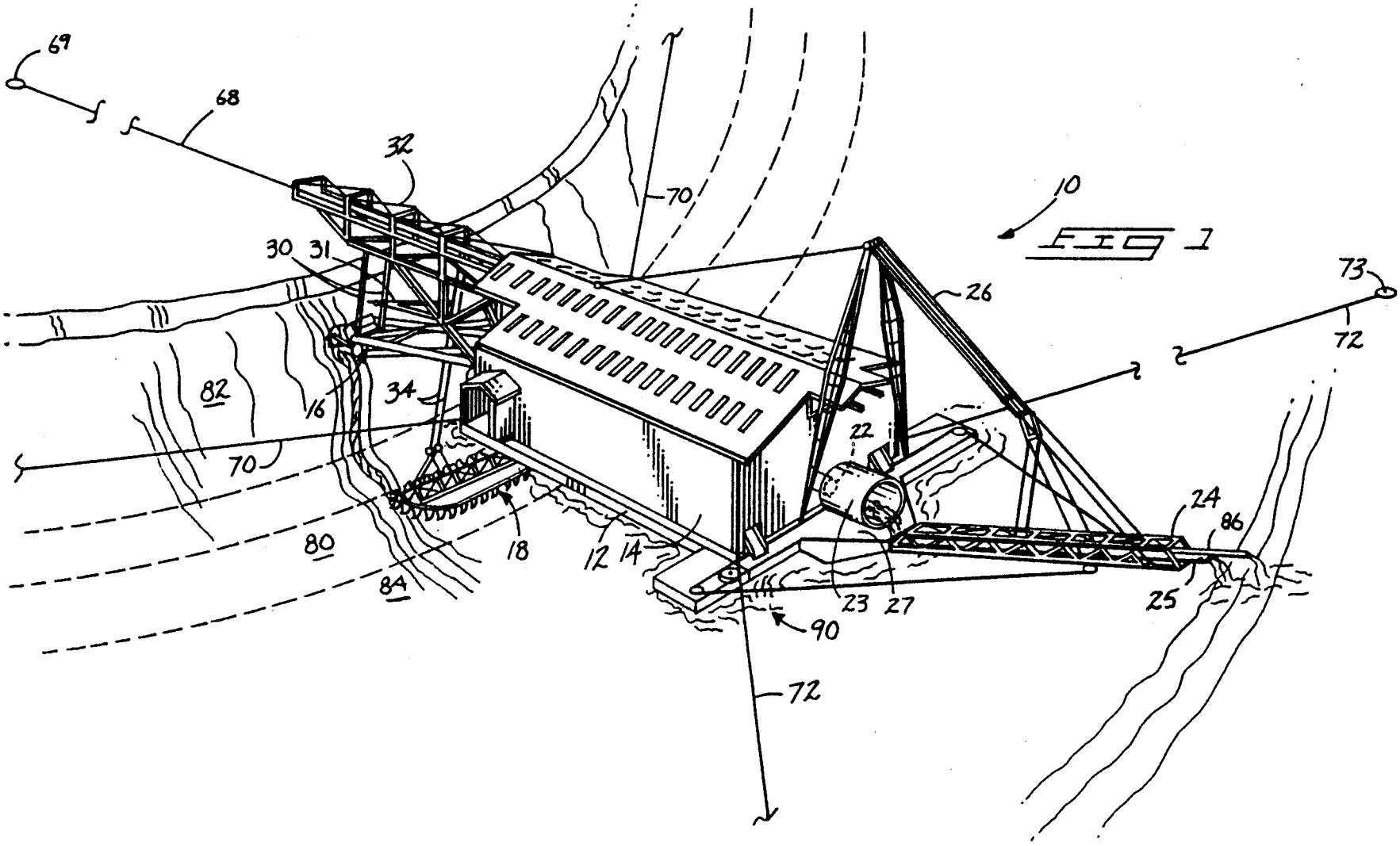
FIG. 1 is an overhead perspective view of a dredging apparatus in accordance with the invention shown anchored in position and excavating overburden and ore material.

The following disclosure of the invention is submitted in compliance with the constitutional purpose of the Patent Laws "to promote the progress of science and useful arts" (Article 1, Section 8).

The apparatus of the instant invention is designed to efficiently and economically excavate a large amount of overburden material simultaneously while excavating smaller volumes of underlying pay material containing desired minerals. The excavation of the overburden and pay materials is carried on in a separate yet coordinated manner. The invention also comprises an improved hydraulic dredging apparatus.

A dredging apparatus for excavating overburden and ore material is indicated generally with reference numeral 10. Dredge 10 includes a floating pontoon section 12 which supports various dredging equipment. A building-like enclosure 14 atop pontoon 12 protects the various equipment from the weather.

A first excavating means 16, alternately termed overburden excavator 16, is mounted to and extends from the forward or bow end of pontoon 12 for excavating and transporting overburden material thereto. A second excavating means 18, alternately termed ore excavator 18, extends from pontoon 12 for excavating and transporting underlying ore material to pontoon 12 simultaneously while the overburden material is being excavated by first excavating means 18. The first and second excavating means extend from pontoon 12 in the same generally vertical plane. Second excavating means 18 is positioned rearwardly of first excavating means 16 such that the first excavating means excavates longitudinally ahead of the second excavating means. Both first and second excavating means are each mounted to pontoon 12 for pivotal movement about respective transverse horizontal axes 17, 19, respectively.

The outermost end portion of first excavating means 16 is connected by a cable assembly 30 to an overhead crane support 32 extending from the bow end of pontoon 12. Cables 30 can be effectively extended or shortened by conventional winches to pivot first excavating means 16 about its transverse pivot axis 17. This raises or lowers the outermost end of first excavating means 16 relative to the water level and face of overburden material being excavated. Such pivotal movement also selectively moves the outward end of the first excavating means longitudinally in an arcuate manner relative to pontoon 12. A conventional water cannon 31 is also mounted to crane support 32 for removing material on the portion of the face of material extending above the water line.

A series of cables 34 also extends downwardly from the rear portion of crane assembly 32 for connecting adjacent the outer end of second excavating means 18. The effective length of cables 34 can also be shortened or lengthened using conventional winches for moving the outer end of second excavating means 18 relative to the face of pay material being excavated.

Processing means 20, well known in the art, are provided on pontoon 12 for receiving material from second excavating means 18 for separation into retained pay material and waste material. Processing means 20 is preferably in the form of pairs of conventional trommels and jigs used to separate the desired minerals from waste material in the dredged ore. The pay material is generally retained on the pontoon for subsequent removal while the waste material from the dredged ore is discharged outwardly from the pontoon.

First excavating means 16 has a hydraulic conveyor system 22 which transports the excavated overburden material to the rear of the pontoon and discharges it into a dewatering trommel 23. The oversize and waste material passing through trommel 23 is discharged onto a belt conveyor 25. The water and undersize material passing from trommel 23 can be discharged overboard, or more preferably the undersize material separated by a hopper 27 positioned beneath trommel 23. The undersize material is then transported from hopper 27 to the feed section of processing means 20 to collect any values that might be present in the overburden material.

Belt conveyor 25 extends rearwardly of pontoon 12 and is supported by a swingable discharge conveyor support arm 24. Discharge support arm 24 also receives a discharge pipe or hydraulic conveyor 86 extending from a selected topsoiling fines waste portion of processing means 20. Support arm 24 is mounted for pivotal movement about both horizontal and vertical axes and is supported by a controllable cable and winch assembly 26. Side-to-side swinging movement is imparted by a conventional winch structure 90. With such a construction, discharge material can be conveniently spread rearwardly of pontoon 12 at any desired elevation.

The first and second excavating means can take a variety of forms. First excavating means 16 is preferably constructed to function as a hydraulic dredging apparatus removing material cut from a face by suction. Second excavating means 18 is preferably in the form of a conventional endless bucket line conveyor. The first excavating means preferably has a higher dredging capacity or rate than the second excavating means for moving the greater volume of overburden material.

Referring to FIGS. 4–8, a first excavating means 18 in accordance with the invention includes an "A" shaped support arm structure 36 connected at its base to the bow end of pontoon 12. The tip or outermost end of A-shaped support structure 36 carries a cutting head assembly 38. Cutting head assembly 38 is comprised of two rotary cutting wheels 40, 42 transversely spaced from one another a predetermined distance along a transverse cutting axis 44. Cutting wheels 40, 42 each comprise a plurality of projecting teeth 46 preferably spaced from one another by a predetermined angular spacing. Teeth 46 of each wheel are configured or oriented for cutting primarily axially or transversely outward in opposing first and second directions generally along transverse cutting axis 44 when cutting wheels 40, 42 are caused to rotate in a clockwise direction as viewed in FIGS. 4, 7 and 8. Accordingly, each cutting wheel is adapted for cutting primarily in its one generally outward transverse direction relative to the length of pontoon 12 as wheels 40, 42 are caused to rotate and cutting head assembly 38 to be moved transversely relative to pontoon 12.

The predetermined angular spacing between teeth 46 is designed such that material removed from the face of a predetermined size is able to pass between adjacent teeth and into the space between the wheels. Alternate and more complex teeth geometries could also of course be employed which enable removed material to pass to the space between the wheels. A preferred example would be to mount teeth to project in a circumferential manner along rapidly projecting vanes. The vanes would be angled to direct removed material inwardly to the space between the wheels as the wheels rotate and cut material from the face.

Wheels 40, 42 are rotatably driven by a drive motor 50 which is mounted within a watertight vault 74 rearwardly adjacent the cutting wheels. Wheels 40. 42 and their associated cutting teeth 46 function as a rotary ripping means for removing material from a face of material upon their rotation by drive motor 50.

First excavating means 16 further includes suction means 48 positioned in the space between cutting wheels 40, 42 for hydraulically transporting removed material away therefrom. A pump drive motor 54 is mounted within another watertight vault 76 rearward of vault 74 for rotatably driving pump 52. An input suction pipe 55 extends outwardly from pump to a position between cutting wheels 40, 42 and below cutting axis 44. The outermost end of input suction pipe 55 includes an extendable end section in the form of an arcuately movable telescoping pipe section 56. Pipe section 56 includes a radially projecting pivot arm 60 which extends to a pivot pin 62 for supporting pipe section 56 for pivotal movement about a transverse pivot axis. Telescoping section 56 is selectively movable into and out of the end of pipe 55 by means of a piston/-cylinder assembly 58 connected between support arm 36 and pivot arm 60. In this manner, the outermost end of suction means 48 is extendible generally in the direction of the face of material to function as an adjustment means. The adjustment means is utilized to maintain the suction force in close proximity to the face of material as cutting head assembly 38 is moved elevationally relative thereto, as will be more fully described below.

A sizing grill or grate 64 is positioned between cutting wheels 40, 42 elevationally above cutting axis 44. Grate 64 has a generally arcuate outer shape conforming to the arcuate outer shape of cutting wheels 40, 42. A shroud 66 is positioned above the rearwardmost end of grate 64 and extends rearwardly to vault 74 in which cutting wheel drive motor 50 is retained. Grate 64 functions to down-size overburden material removed from the face of material by cutting wheels 40, 42 as it is drawn toward suction pipe 55 by suction action.

Referring again to FIG. 1, a headline system is employed for anchoring pontoon 12. The system consists of a headline 68 extending from the upper fore end of the dredge, along crane assembly 32, to an anchoring device 69 which is located in front of the dredge on shore. Anchor 69 to which headline 68 is secured serves as the pivot point about which the pontoon is pivoted from side to side in an arcuate path when dredging. A pair of swing lines 70 is secured to the bow end of pontoon 12 and secured to additional anchoring devices (not shown) located on shore. These shore anchors are generally in the form of winches or motorized vehicles for pulling on one of swing lines 70 to cause the pontoon to be arcuately moved about the pivot point. The rear portion of pontoon 12 is anchored by a pair of lines 72 extending therefrom to additional anchors 73 located on shore for keeping headline 68 taut.

Figure 9:
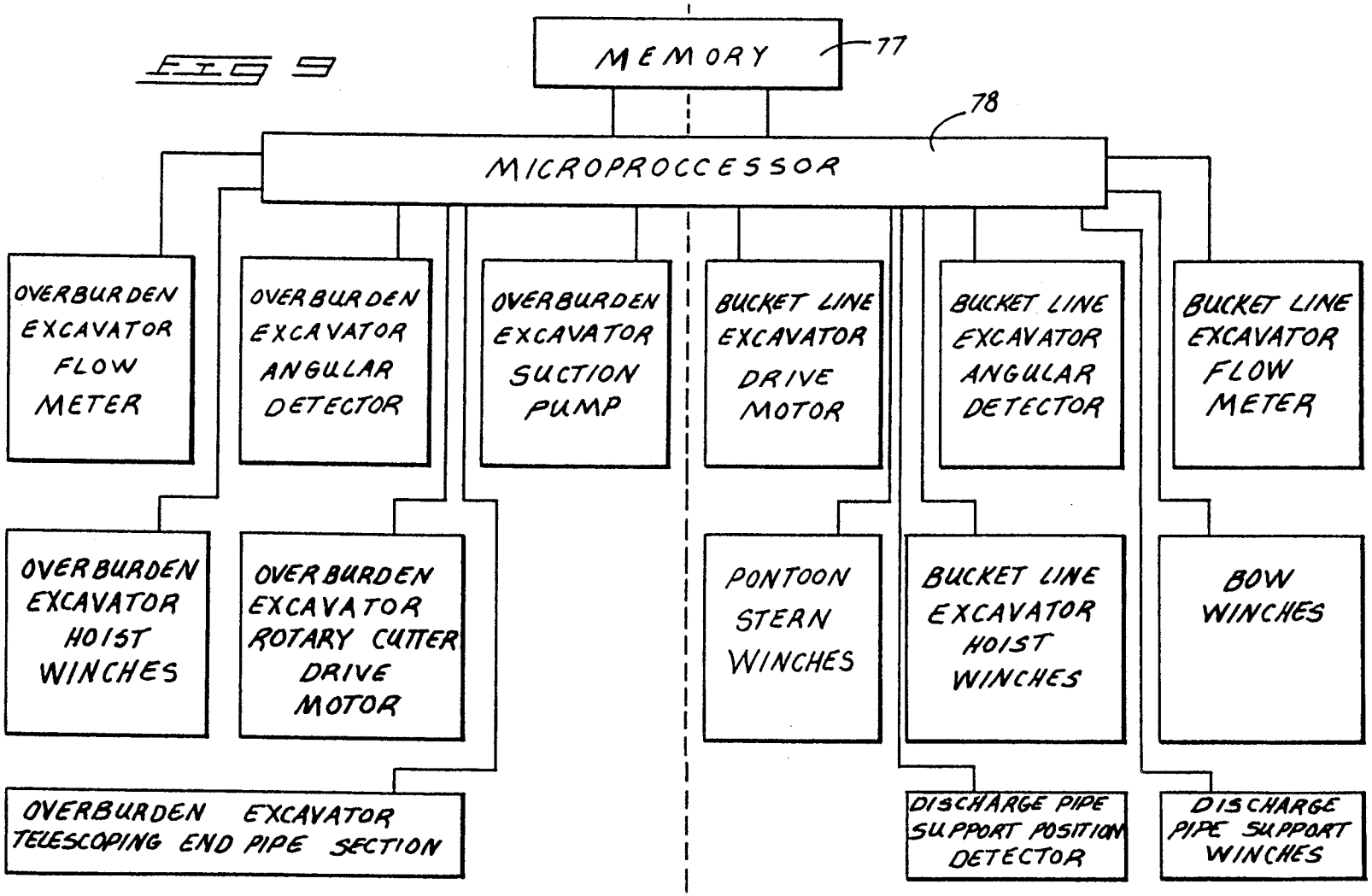
FIG. 9 is a block diagram of dredging control means usable for efficiently operating the dredging apparatus of FIG. 1.

Both first and second excavating means 16, 18 are independently operable of each other. Dredging control means are provided for coordinating their operation to efficiently remove both overburden and ore material during their simultaneous operation. A block diagram of microprocessor controlled dredging control means is illustrated in FIG. 9. The dredging control means includes a microprocessor 78 which receives information and controls both the hydraulic and mechanical operational aspects of the dredge. The microprocessor operates to coordinate the various dredging components so that the alluvial deposits are most efficiently dredged. Most preferably, the deposits being dredged have been surveyed and sampled prior to beginning the dredging operation. Information obtained from the survey and sampling are input into memory components 77 accessible by the microprocessor for proper mining of the overburden and ore material by the respective overburden and ore excavators in the most efficient manner.

Figure 2:
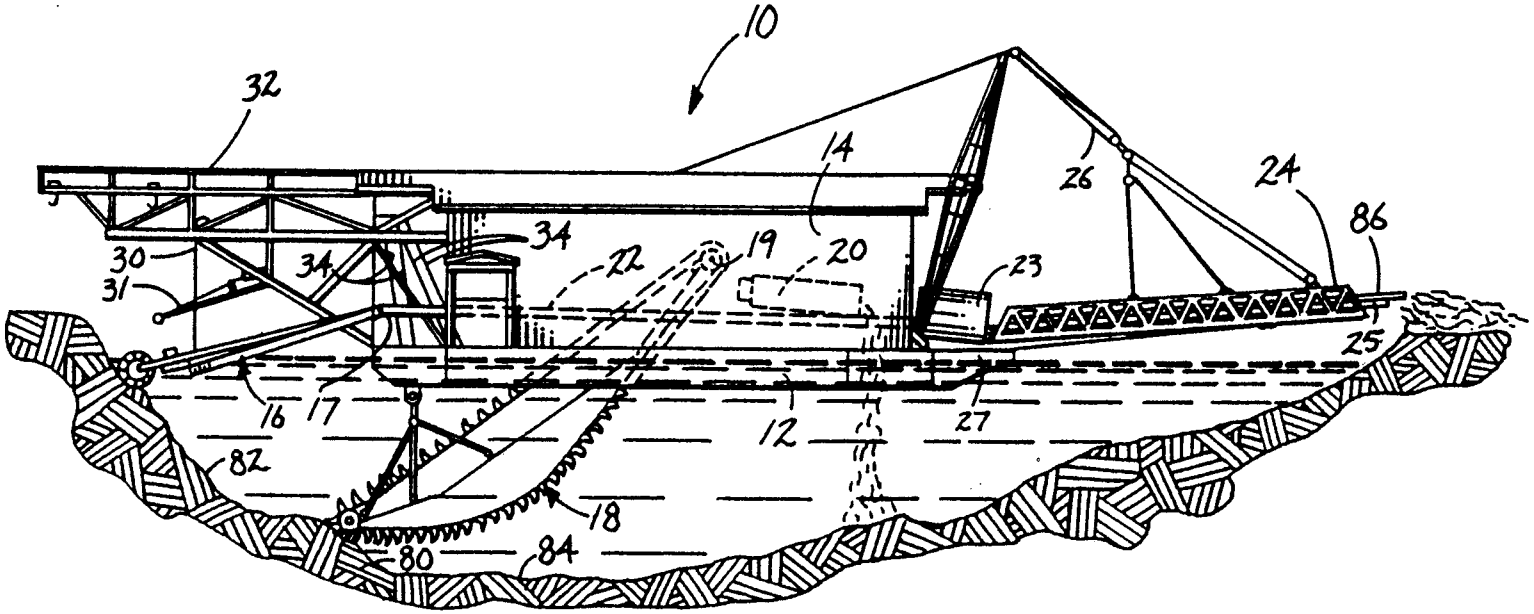
FIG. 2 is a side elevational view of the dredging apparatus of FIG. 1.
Figure 3:
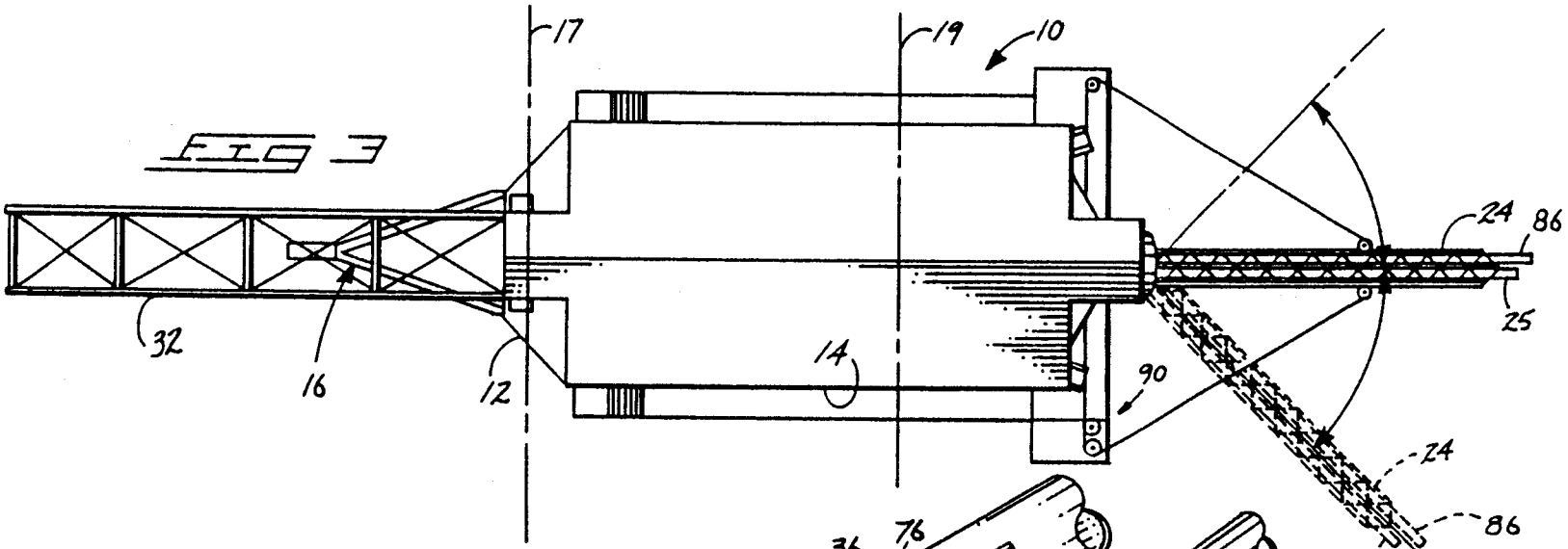
FIG. 3 is a top view of the dredging apparatus of FIG. 1.
Figure 5:
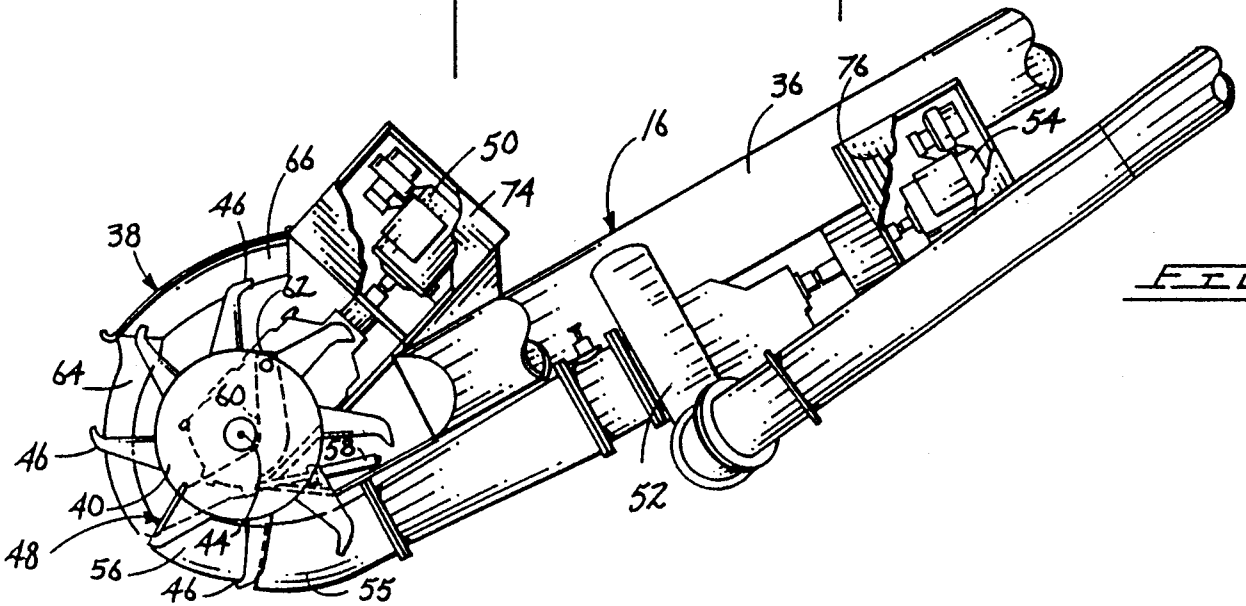
FIG. 5 is yet a further enlarged side elevational view of the hydraulic dredging apparatus of FIG. 1.
Figure 4:
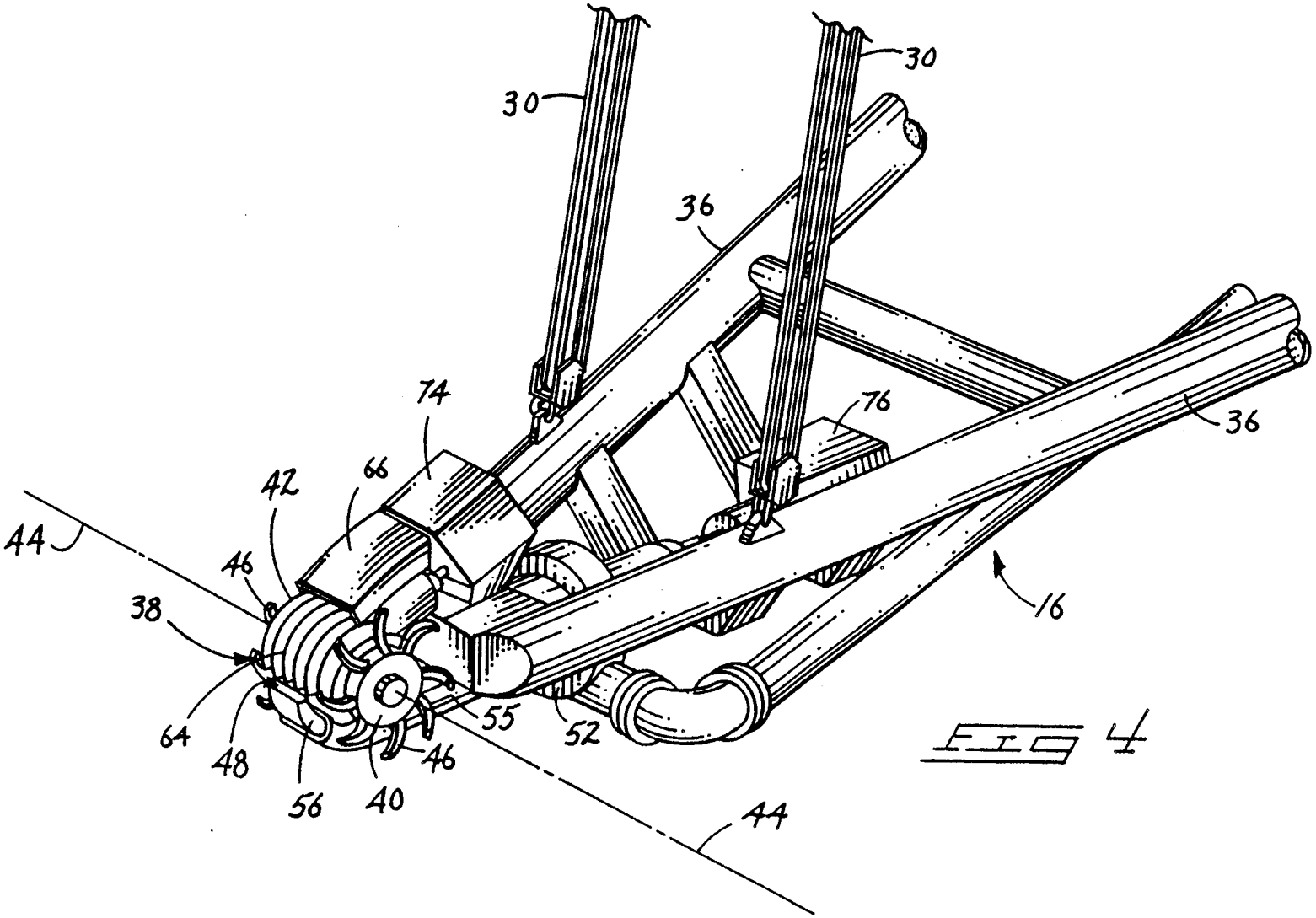
FIG. 4 is an enlarged perspective view of a hydraulic dredging apparatus used as part of the dredging apparatus of FIG. 1 in accordance with the invention.

A typical method of excavating overburden material and ore material using a pontoon mounted floating dredge such as the one just described follows. To begin operation, pontoon 12 is first positioned so that both the overburden and ore excavators 16, 18 can reach the face material to be excavated. Next, overburden excavator 16 is lowered until it is in position to excavate overburden material 82 adjacent the water line (FIG. 2). Drive motor 50 is then engaged to start cutter wheels 40, 42 rotating clockwise. Additionally, suction pump 52 is engaged by pump motor 54 to begin the suction action. With cutter wheels 40, 42 rotating and suction pump 52 operating pontoon 12 is caused o pivot about headline anchor 69 by pulling on one of swing lines 70 to pull the pontoon in one arcuate direction. The one of cutting wheels 40 or 42 in the pulling direction engages the face of the overburden material and rips material therefrom as it rotates. The other of cutting wheels 40 or 42 provides minimal cutting action against the face when moving in the transverse direction towards the other wheel. A portion of the removed material is forced upwardly by the clockwise rotation of the cutting wheel and drawn through grates 64 by suction action towards the outer end of suction pipe section 56. Additional removed material travels between the teeth of the cutting wheel from the leading direction of the cut toward the suction pipe section 56. In this manner, the rotating cutting wheels also function as a rotary grizzly means for downsizing removed material as it is fed to the suction means. In other words, material larger than the spacing between adjacent teeth on the leading cutting wheel is worked by the wheel until its size is reduced to the point where it is able to pass between adjacent cutter teeth 46.

Upon reaching the end of the cutting stroke in one direction, microprocessor 78 acts to lower support 36 to position cutting head 38 downwardly on the face of overburden material 82. The barge is then pulled in the other direction making the cutting wheel which was trailing now the leading cutter. This operation is continued until such time as overburden excavator 18 has reached the upper portion of "pay" material 80.

Figure 7:
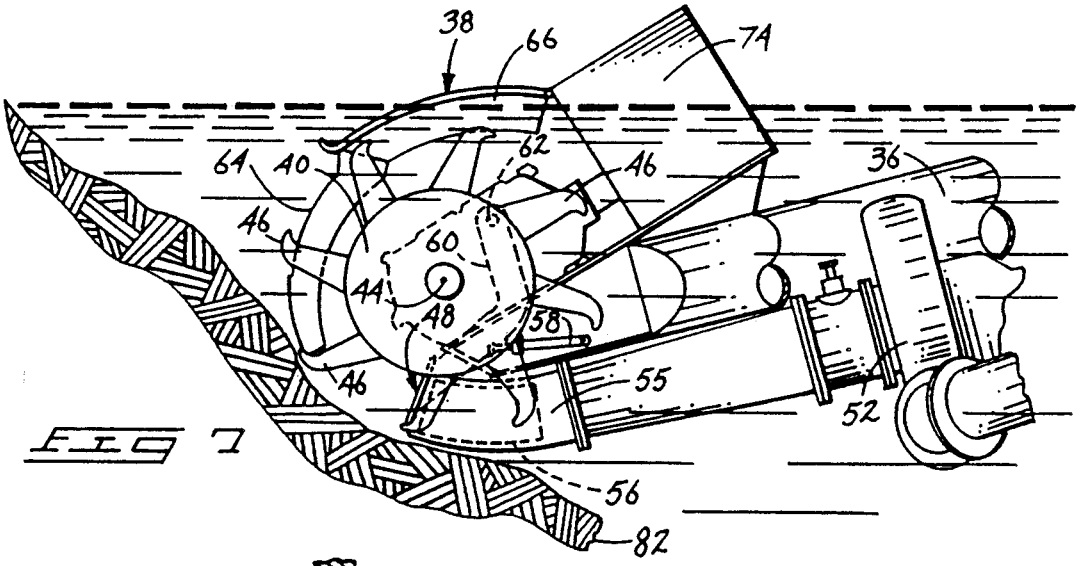
FIG. 7 is a side view of the hydraulic dredging apparatus of FIG. 4 shown in a first operating position.
Figure 8:
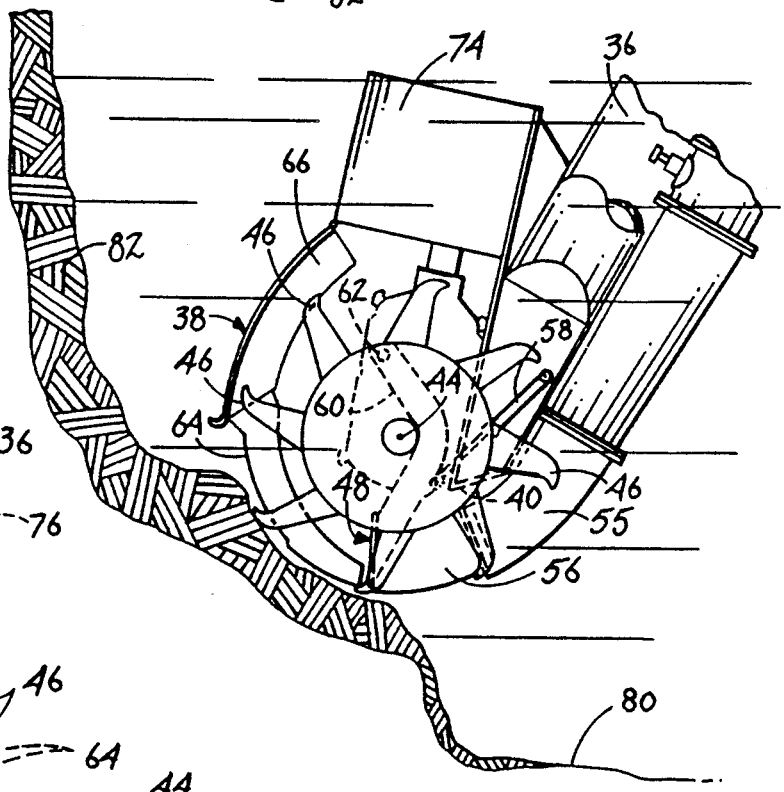
FIG. 8 is a side view of the hydraulic dredging apparatus of FIG. 4 shown in a second operating position.
Figure 6:
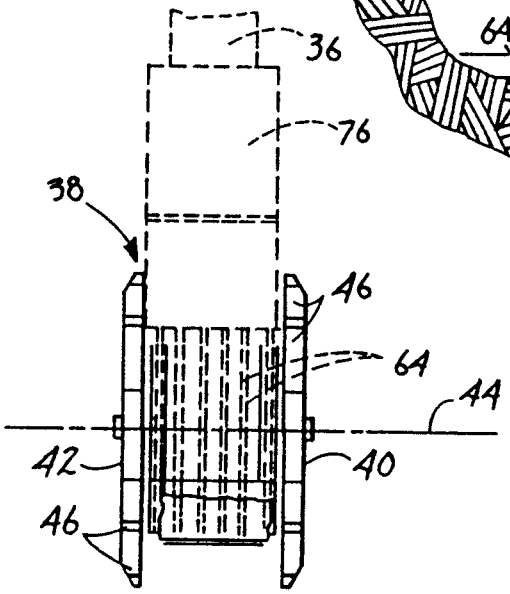
FIG. 6 is an end view of the hydraulic dredging apparatus of FIG. 4.

The preferred operational arrangement with respect to the suction means is to keep the end of suction pipe 56 as close as practical to the face of material adjacent here the cutting teeth are working. FIGS. 7 and 8 illustrate that telescoping section 56 of suction pipe 55 is progressively extended outwardly towards the mined face of overburden material 82 as cutting head 38 is moved downwardly. FIG. 7 illustrates that when the support arm of the cutting wheel is configured to be near horizontal or near the water line, the telescoping section 56 is retracted as the cutting teeth work against the face adjacent the entrance to the suction pipe. As support arm 36 is moved downwardly, telescoping section 56 is extended to effectively place the outermost extent of suction pipe 55 near that portion of the cutting teeth which are acting on the face, as shown in FIG. 8.

Overburden excavator 16 is operated until a cut profile such as shown in FIG. 2 is attained. Namely, the overburden material is excavated to provide a longitudinal spacing between the face of overburden material 82 and the face of pay material 80. At this point, the bucket line excavator 18 is lowered to a position at the top of the face of the pay material 80. Overburden excavator 16 is positioned adjacent the water line. With both in position, pontoon 12 is swung to one side. As it swings, ore excavator 18 removes a layer of pay zone material which is conveyed to processing means 20 on pontoon 12. The desired ore material is there separated and retained on the pontoon. Waste material from the processing means is either dropped directly overboard or selected top soiling material is directed to the shore through pipe 86 supported by conveyor support 24. At the same time, overburden excavator 16 removes a layer of overburden material. The excavated overburden material is discharged into trommel 23, with the oversize and waste material dumping onto belt conveyor 25 and deposited externally onto the spoil pile. The undersize material is collected by hopper 27 and pumped up and added to the processing means 20 system of recovery. When dredge 10 reaches its limit of travel in one direction, both the ore excavator and overburden excavator would be rotated downwardly a suitable amount so as to begin excavating a new layer of ore and overburden material respectively. This procedure is repeated until the ore excavator has excavated all of the "pay" material down to bedrock layer 84.

The dredging control means coordinates the dredging rates and positioning of the dredges to effectively remove the ore and overburden material. As should be readily apparent, the overburden excavator has a greater capacity of removing overburden material in the preferred embodiment.

Figure 10:
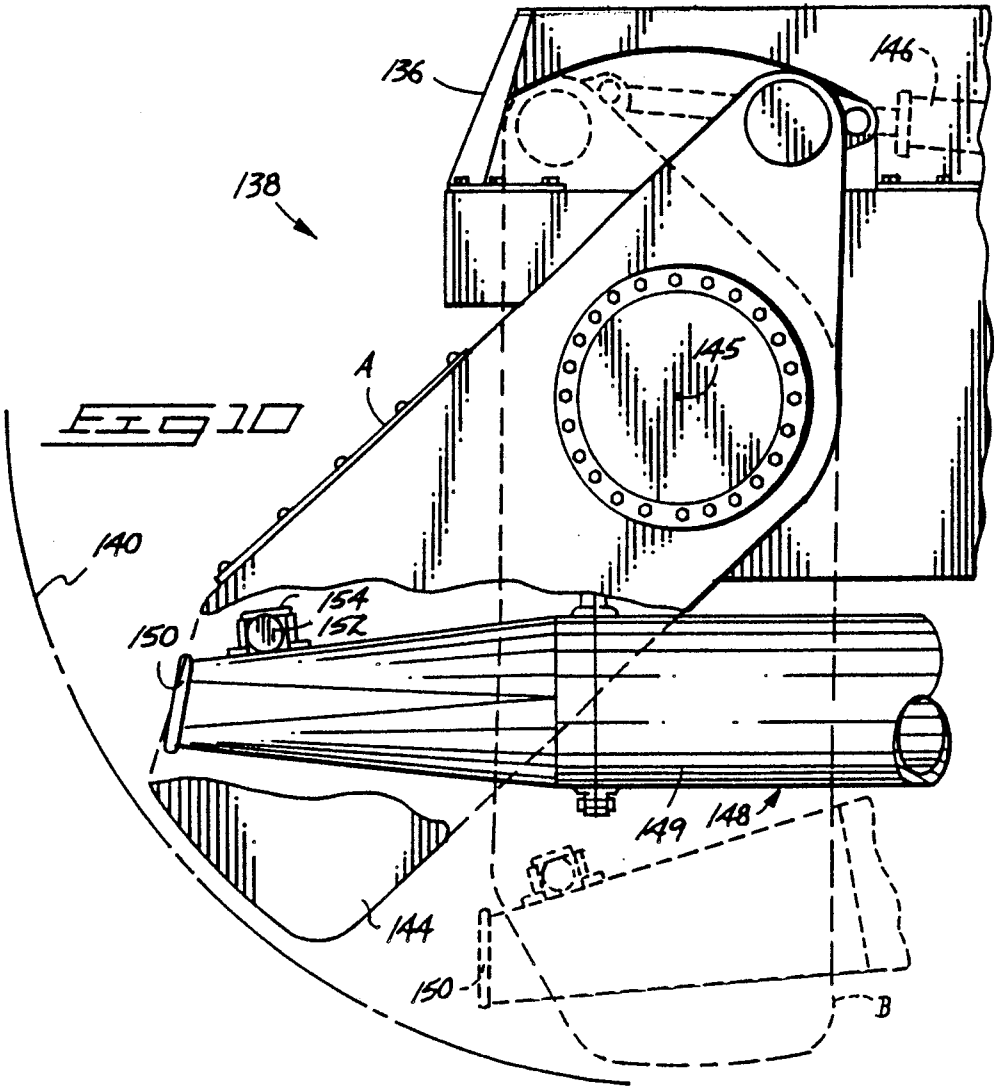
FIG. 10 is a fragmentary, partial side elevational view of the dredging head portion of an alternate embodiment hydraulic dredging apparatus in accordance with the invention.
Figure 11:
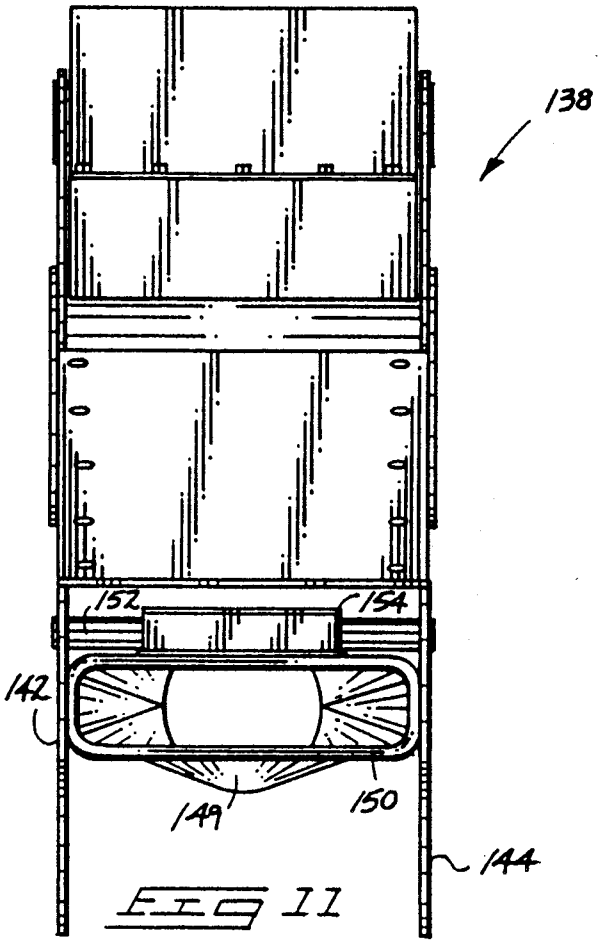
FIG. 11 is a front end view of FIG. 10.

Referring to FIGS. 10 and 11, an alternate dredging head assembly is indicated generally by reference numeral 138. Dredging head 138 includes an alternate adjustment means for maintaining the suction means in close proximity to the face of the material as the cutting head is moved elevationally relative thereto. The cutting wheels of cutting head 138 have been removed for clarity. The outside diameter of such cutting wheels however is indicated by line 140.

As in the previous design, a support arm 136 supports various components at the end of cutting head assembly 138. A movable end section 149 is provided in the end of the suction means to accommodate desired positioning of the suction means relative to the face of material being mined. The outermost end of end section 149 tapers inwardly to form an elongated suction mouth 150. A pair of plate like pivot arms 142, 144 are pivotally mounted at the outer end of support arm 136 and operably connect support arm 136 to movable end section 149. The elongated width of suction mouth 150 extends substantially the entire distance between pivot arms 142, 144 and correspondingly the cutting wheels.

Pivot arms 142, 144 are positioned immediately inward and adjacent of the cutting wheels (not shown), and are pivotal between extreme positions "A" and "B" about a pivot axis 145 on support arm 136. A piston/cylinder assembly 146 is supported atop support arm 136 above pivot axis 145. Assembly 146 engages an interconnection bar (not shown) extending between arms 142, 144 for simultaneously pivoting arms 142, 144 about axis 145.

Pivot arms 142, 144 pivotally suspend extendible end section 149 therebetween for movement relative to the face of material being mined. In the depicted embodiment, this is accomplished by a circular cross-sectioned support bar 152 which is anchored to and extends between arms 142, 144. An elongated, square cross-sectioned receiver tube 154 is formed from metal strips atop end section 149 adjacent suction mouth 150. Formed tube 154 slidably receives support bar 152 therethrough in such a manner that the movable end section 149 and support bar 152 are pivotal relative to one another. End section 149 could also of course be pivotally suspended in other manners between plates 142, 144, such as by a support bar engaging beneath the end section. Alternately, end section 149 could be pivotally suspended from its sides relative to each of pivot arms 142, 144.

FIG. 10 illustrates the extent of pivotal movement of pivot arms 142, 144 and correspondingly the typical extreme positions between which suction mouth 150 is movable to assist in maintaining the suction mouth in close proximity to the face of material being worked. The "A" position would be employed for operational configurations of the hydraulic dredge such as. for example, shown in FIG. 8. The "B" position would be used where the dredge is configured as, for example, shown in FIG. 7.

To accommodate longitudinal movement of end section 149 relative to support arm 136 and correspondingly the face of material being mined, end section 149 is preferably telescopically connected to a fixed suction tube (not shown) near the end of support arm 136. Alternately, a flexible and expandable tube could interconnect the fixed suction tube with movable end section 149, such as for example shown in U.S. Pat. Nos. 4,242,814 and 4,302,893. any possible connections would exist as will be appreciated by the artisan.

Figure 12:
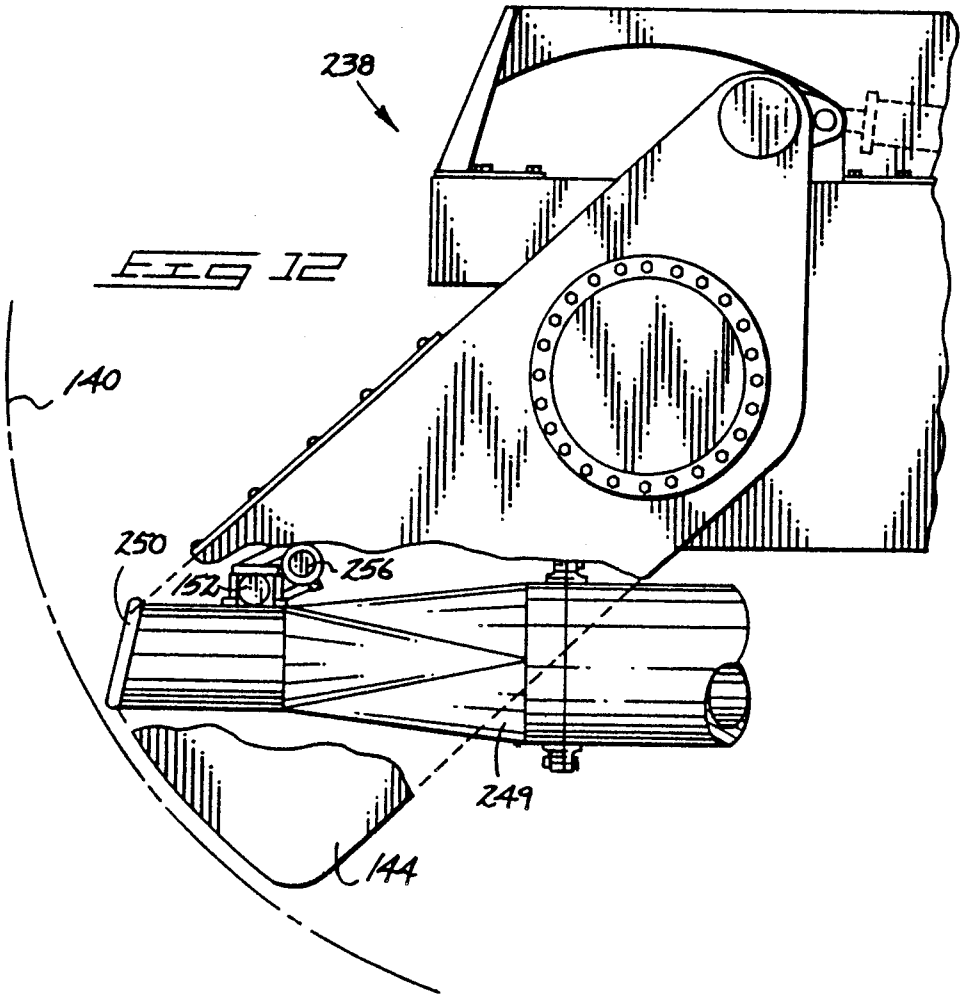
FIG. 12 is a fragmentary, partial side elevational view of the dredging head portion of another alternate embodiment hydraulic dredging apparatus in accordance with the invention.
Figure 13:
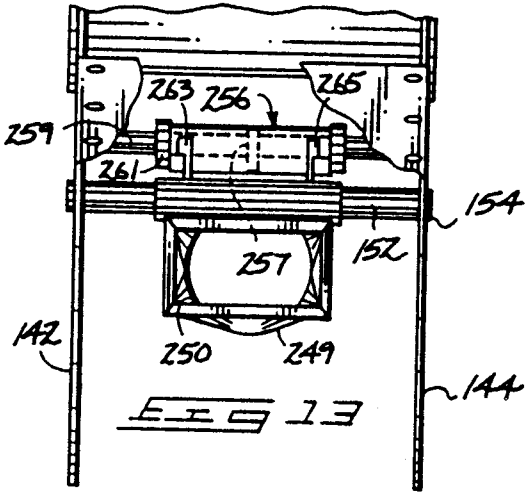
FIG. 13 is a reduced partial front end view of FIG. 12.
Figure 14:
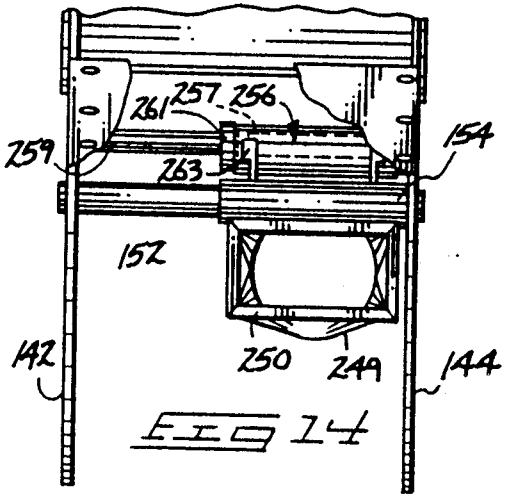
FIG. 14 is a reduced partial front end view like FIG. 13, but illustrating a specific operational configuration.

FIGS. 12–14 illustrate another dredging head 238. The 238 head is similar to the 138 head such that only the differences will be highlighted. In this embodiment, the end section 249 tapers inwardly to a narrower width suction mouth 250. The suction mouth width is approximately half the predetermined distance between pivot arms 142, 144. Because of this narrower width a greater amount of suction force is exerted at mouth opening 250 than at mouth opening 150 of head 138. Suction mouth 250 is movable transversely to any position between pivot arms 142, 144 and correspondingly the rotary cutting wheels.

A piston and cylinder assembly 256 extends between pivot arms 142, 144 rearwardly adjacent support bar 152 and engages support tube 154 mounted atop the end section 249. A piston 257 of assembly 256 is supported by a rod 259 extending therethrough and between pivot arms 142, 144. A cylinder 261 surrounds piston 257 and is in fluid sealing engagement relative to rod 259. The length of cylinder 261 is approximately equal to the width of mouth 250. Cylinder 261 is secured relative to end section tube 154 by a pair of support arms 263, 265.

By selectively charging cylinder 261 with fluid either to the left or right of piston 257, the suction mouth 250 can selectively be driven in the left or right direction, respectively. Accordingly, assembly 256 functions as a positioning means for selectively moving suction mouth 250 transversely between the rotary cutting wheel to selectively orient the mouth adjacent to one of the wheels. Alternate positioning means could of course be employed as will be appreciated by the artisan.

Operation of such a dredging head could proceed as follows. FIG. 14 illustrates the desired orientation of suction mouth 250 when the hydraulic dredging head is being swung to the right as viewed from FIG. 14. Suction mouth 250 is positioned by piston/cylinder assembly 256 to the right. This concentrates a greater amount of suction force immediately adjacent the working wheel than in the previously described embodiments. When the swinging stroke to the right is completed, mouth 250 would be swung to the opposite (left) side between the wheels and the dredging head swung to the left.

The width of mouth 250 could of course be some other width than approximately one-half the distance between plates 142, 144 and correspondingly the cutting wheels. The mouth width should preferably be some significant amount less than that of the FIGS. 10 and 11 embodiment to enable a concentration of suction force in the direction of cutting head movement.

Figure 15:
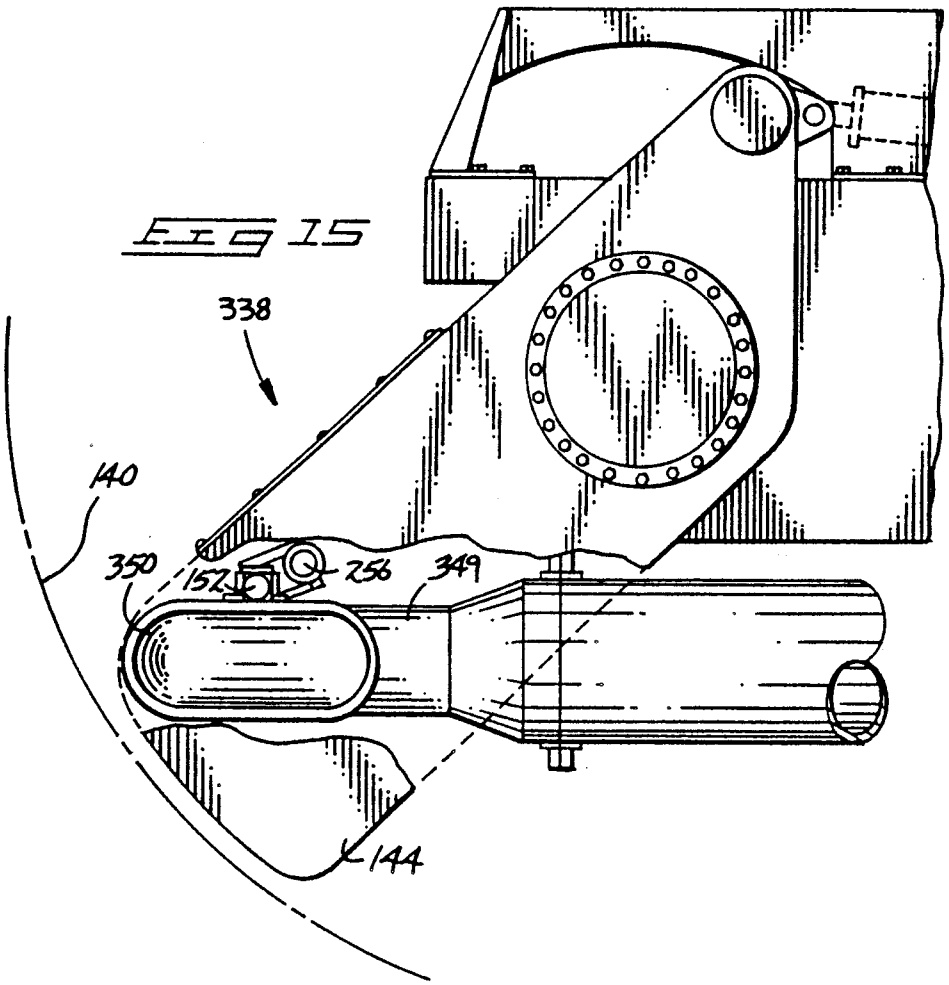
FIG. 15 is a fragmentary, partial side elevational view of the dredging head portion of still another alternate embodiment hydraulic dredging apparatus in accordance with the invention.
Figure 16:
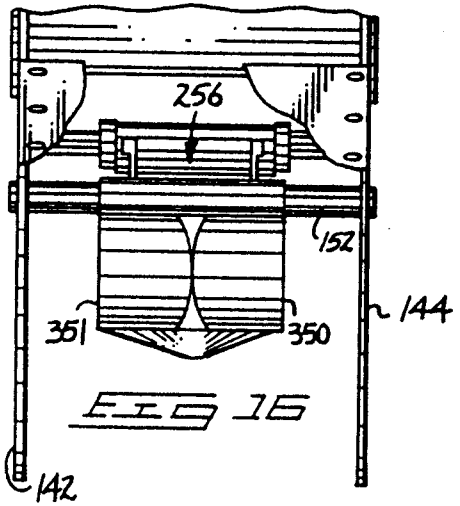
FIG. 16 is a reduced partial front end view of FIG. 15.
Figure 17:
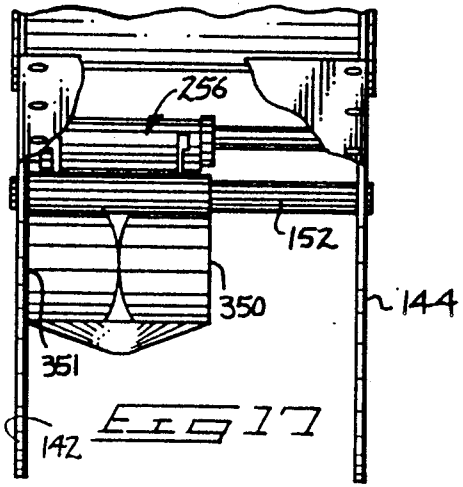
FIG. 17 is a reduced partial front end view like FIG. 16, but illustrating a specific operational configuration.

FIGS. 15–17 illustrate yet another alternate construction dredging head 338 for concentrating suction force in the direction of dredging head movement. Head 338 is similar to head 238 such that only the differences are described. The movable end section 349 is constructed to form two generally opposed suction mouths 350 and 351. Both suction mouths 350, 351 are elongated, being wider than they are high. Each face in opposite transverse directions. The overall width of the outer end of movable end section 349 is again less than the overall spacing between pivot arms 142, 144. A combination piton/cylinder assembly 256 is again provided between pivot arms 142, 144 to accommodate side to side transverse movement of end section 349 between the cutting wheels.

The operational configuration of end section 349 between the cutting wheels is, however, exactly opposite to that employed in the FIGS. 12–14 embodiment. For example, referring to FIG. 17, when the dredge head is being swung to the right, movable end section 349 is positioned to the left. This effectively closes off the left suction mouth 351 which bears against pivot arm 142. This enables all of the suction force to be drawn through suction mouth 350 which is facing in the direction of dredging head movement.

The overall width of the outer end of end section 349 is preferably constructed to be greater than one-half of the distance between arms 142, 144. This places the particular working suction mouth in reasonably close proximity to the working cutting wheel. The diameter however is not so great as to permit the particular arm 142 or 144 which is positioned in front of the working suction mouth to have a significant adverse effect on the suction which is generated.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

We claim:

1. A dredging apparatus for excavating overburden and ore material, comprising:

a pontoon;

first excavating means extending from the pontoon for excavating and transporting overburden material to the pontoon;

second excavating means extending from the pontoon for excavating and transporting underlying ore material to the pontoon simultaneously while the overburden material is being excavated, the first and second excavating means being independently operable;

dredging control means for coordinating operation of the first and second excavating means to efficiently remove both overburden and ore material during their simultaneous operation;

the first excavating means comprising a hydraulic dredging apparatus, the hydraulic dredging apparatus comprising:

a support arm;

a cutting head supported adjacent one end of the support arm, the cutting head comprising:

rotary ripping means for removing overburden material from a face of overburden material, the rotary ripping means being mounted for rotation about a cutting axis, the rotary ripping means comprising at least two rotary cutting wheels transversely spaced from one another a predetermined distance along the cutting axis and thereby defining a space between the wheels, each cutting wheel comprising a plurality of projecting teeth configured relative to one another to enable removed material of a predetermined size to pass to the space between the wheels, the teeth of one wheel being oriented for cutting primarily in one generally transverse direction as the cutting wheels are caused to rotate and be axially moved in the one generally transverse direction, the teeth of the other wheel being oriented for cutting primarily in a second generally transverse direction opposite to the one transverse direction as the cutting wheels are caused to rotate and be axially moved in the second transverse direction;

power drive means for rotationally driving the rotary ripping means;

suction means positioned in the space between the two rotary cutting wheels for hydraulically transporting removed material away from the cutting head; and adjustment means for maintaining the suction means in close proximity to the face of material as the cutting head is moved elevationally relative to the face of material, the adjustment means comprising:

an extendible end section provided in the suction means, the extendible end section being mounted for movement which is substantially perpendicular relative to the cutting axis and into and away from the face of the material; and pivot arm means connected between the support arm and extendible end section for moving the extendible end section of the suction means relative to the face of material, the pivot arm means being pivotal about a pivot axis which is substantially parallel with the cutting axis.

2. The dredging apparatus of claim 1 wherein the extendible end section is pivotally suspended between the rotary cutting wheels from the pivot arm means about an axis which is substantially parallel with the cutting axis.

3. The dredging apparatus of claim 1 wherein the extendible end section includes a suction mouth, the suction mouth having an overall width which is significantly less than the predetermined distance between the cutting wheels, the suction mouth being mounted for physical movement between the rotary cutting wheels and positioning means for selectively moving the suction mouth transversely between the rotary cutting wheels to selectively orient the suction mouth adjacent to one of the wheels.

4. The dredging material of claim 3 wherein the extendible end section includes two suction mouths, one mouth generally facing the one transverse direction, the other mouth generally facing the second transverse direction.

5. A dredging apparatus for excavating overburden and ore material, comprising:

a pontoon;

first excavating means extending from the pontoon for excavating and transporting overburden material to the pontoon;

second excavating means extending from the pontoon for excavating and transporting underlying ore material to the pontoon simultaneously while the overburden material is being excavated, the first and second excavating means being independently operable;

dredging control means for coordinating operation of the first and second excavating means to efficiently remove both overburden and ore material during their simultaneous operation;

the first excavating means comprising a hydraulic dredging apparatus, the hydraulic dredging apparatus comprising:

a support arm;

a cutting head supported adjacent one end of the support arm, the cutting head comprising:

rotary ripping means for removing overburden material from a face of overburden material, the rotary ripping means being mounted for rotation about a cutting axis, the rotary ripping means comprising at least two rotary cutting wheels transversely spaced from one another a predetermined distance along the cutting axis and thereby defining a space between the wheels, each cutting wheel comprising a plurality of projecting teeth configured relative to one another to enable removed material of a predetermined size to pass to the space between the wheels, the teeth of one wheel being oriented for cutting primarily in one generally transverse direction as the cutting wheels are caused to rotate and be axially moved in the one generally transverse direction, the teeth of the other wheel being oriented for cutting primarily in a second generally transverse direction opposite to the one transverse direction as the cutting wheels are caused to rotate and be axially moved in the second transverse direction;

power drive means for rotationally driving the rotary ripping means;

suction means positioned in the space between the two rotary cutting wheels for hydraulically transporting removed material away from the cutting head; and adjustment means for maintaining the suction means in close proximity to the face of material as the cutting head is moved elevationally relative to the face of material, the adjustment means comprising:

an extendible end section provided in the suction means, and pivot arm means connected between the support arm and extendible end section for moving the extendible end section of the suction means relative to the face of material, the pivot arm means being pivotal about a pivot axis, the extendible end section being pivotally suspended between the rotary cutting wheel from the pivot arms means, the pivot arm means comprising:

a pair of pivot arms positioned between the cutting wheels with the extendible end section of the suction means being positioned between the pair of pivot arms;

the extendible end section being pivotally suspended from the support bar.

6. The dredging apparatus of claim 5 wherein the extendible end section is suspended beneath the support bar and includes a suction mouth, the suction mouth having a width which extends substantially the entire predetermined distance between the cutting wheels.

7. The dredging apparatus of claim 5 wherein the extendible end section includes a suction mouth, the suction mouth having an overall width which is significantly less than the predetermined distance between the cutting wheels; and positioning means for selectively moving the suction mouth transversely between the rotary cutting wheels to selectively orient the suction mouth adjacent to one of the wheels.

8. The dredging apparatus of claim 7 wherein the extendible end section includes two suction mouths, one mouth generally facing the one transverse direction, the other mouth generally facing the second transverse direction.

9. A dredging apparatus for excavating overburden and ore material, comprising:

a pontoon;

first excavating means extending from the pontoon for excavating and transporting overburden material to the pontoon;

second excavating means extending from the pontoon for excavating and transporting underlying ore material to the pontoon simultaneously while the overburden material is being excavated, the first and second excavating means being independently operable;

dredging control means for coordinating operation of the first and second excavating means to efficiently remove both overburden and ore material during their simultaneous operation;

the first excavating means comprising a hydraulic dredging apparatus, the hydraulic dredging apparatus comprising:

a support arm;

a cutting head supported adjacent one end of the support arm, the cutting head comprising:

rotary ripping means for removing overburden material from a face of overburden material, the rotary ripping means being mounted for rotation about a cutting axis, the rotary ripping means comprising at least two rotary cutting wheels transversely spaced from one another a predetermined distance along the cutting axis and thereby defining a space between the wheels, each cutting wheel comprising a plurality of projecting teeth configured relative to one another to enable the moved material of a predetermined size to pass to the space between the wheels, the teeth of one wheel being oriented for cutting primarily in one generally transverse direction as the cutting wheels are caused to rotate and be axially moved in the one generally transverse direction, the teeth of the other wheel being oriented for cutting primarily in a second generally transverse direction opposite to the one transverse direction as the cutting wheels are caused to rotate and be axially moved in the second transverse direction;

power drive means for rotationally driving the rotary ripping means;

suction means positioned in the space between the two rotary cutting wheels for hydraulically transporting removed material away from the cutting head; the suction means including a suction mouth, the suction mouth having an overall width which is significantly less than the predetermined distance between the cutting wheels, the suction mouth being mounted for physical movement between the rotary cutting wheels;

adjustment means for moving the suction means substantially perpendicular relative to the cutting axis to maintain the suction means in close proximity to the face of material as the cutting head is moved elevationally relative to the face of material; and positioning means for selectively moving the suction mouth transversely between the rotary cutting wheels to selectively orient the suction mouth adjacent to one of the wheels.

10. The dredging apparatus of claim 9 wherein the suction means includes two suction mouths, one mouth generally facing the one transverse direction, the other mouth generally facing the second transverse direction.

11. A dredging apparatus comprising:

a support arm;

a cutting head supported adjacent one end of the support arm, the cutting head comprising:

rotary ripping means for removing material from a face of material, the rotary ripping means being mounted for rotation about a cutting axis, the rotary ripping means comprising at least two rotary cutting wheels transversely spaced from one another a predetermined distance along the cutting axis and thereby defining a space between the wheels, each cutting wheel comprising a plurality of projecting teeth configured relative to one another to enable removed material of a predetermined size to pass to the space between the wheels, the teeth of one wheel being oriented for cutting primarily in one generally transverse direction as the cutting wheels are caused to rotate and be axially moved in the one generally transverse direction, the teeth of the other wheel being oriented for cutting primarily in a second generally transverse direction opposite to the one transverse direction as the cutting wheels are caused to rotate and be axially moved in the second transverse direction;

power drive means for rotationally driving the rotary ripping means;

suction means positioned in the space between the two rotary cutting wheels for hydraulically transporting removed material away from the cutting head; and adjustment means for maintaining the suction means in close proximity to the face of material as the cutting head is moved elevationally relative to the face of material, the adjustment means comprising:

an extendible end section provided in the suction means, the extendible end section being mounted for movement which is substantially perpendicular relative to the cutting axis and into and away from the face of the material; and pivot arm means connected between the support arm and extendible end section for moving the extendible end section of the suction means relative to the face of material, the pivot arm means being pivotal about a pivot axis which is substantially parallel with the cutting axis.

12. The hydraulic dredging apparatus of claim 11 wherein the extendible end section is pivotally suspended between the rotary cutting wheels from the pivot arm means about an axis which is substantially parallel with the cutting axis.

13. The hydraulic dredging apparatus of claim 11 wherein the extendible end section includes a suction mouth, the suction mouth having an overall width which is significantly less than the predetermined distance between the cutting wheels, the suction mouth being mounted for physical movement between the rotary cutting wheels; and positioning means for selectively moving the suction mouth transversely between the rotary cutting wheels to selectively orient the suction mouth adjacent one of the wheels.

14. The hydraulic dredging apparatus of claim 13 wherein the extendible end section includes two suction mouths, one mouth generally facing the one transverse direction, the other mouth generally facing the second transverse direction.

15. A hydraulic dredging apparatus comprising:

a support arm;

a cutting head supported adjacent one end of the support arm, the cutting head comprising:

rotary ripping means for removing material from a face of material, the rotary ripping means being mounted for rotation about a cutting axis, the rotary ripping means comprising at least two rotary cutting wheels transversely spaced from one another a predetermined distance along the cutting axis and thereby defining a space between the wheels, each cutting wheel comprising a plurality of projecting teeth configured relative to one another to enable removed material of a predetermined size to pass to the space between the wheels, the teeth of one wheel being oriented for cutting primarily in one generally transverse direction as the cutting wheels are caused to rotate and be axially moved in the one generally transverse direction, the teeth of the other wheel being oriented for cutting primarily in a second generally transverse direction opposite to the one transverse direction as the cutting wheels are caused to rotate and be axially moved in the second transverse direction;

power drive means for rotationally driving the rotary ripping means;

suction means positioned in the space between the two rotary cutting wheels for hydraulically transporting removed material away from the cutting head; and adjustment means for maintaining the suction means in close proximity to the face of material as the cutting head is moved elevationally relative to the face of material, the adjustment means comprising:

an extendible end section provided in the suction means, the extendible end section being pivotally suspended between the rotary cutting wheels from the pivot arm mean; and pivot arm means connected between the support arm and extendible end section for moving the extendible end section of the suction means relative to the face of material, the pivot arm means being pivotal about a pivot axis, the pivot arm means comprising:

a pair of pivot arms positioned between the cutting wheels with the extendible end section of the suction means being positioned between the pair of pivot arms;

a support bar extending between the pivot arms;

the extendible end section being pivotally suspended from the support bar.

16. The hydraulic dredging apparatus of claim 15 wherein the extendible end section is suspended beneath the support bar and includes a suction mouth, the suction mouth having a width which extends substantially the entire predetermined distance between the cutting wheels.

17. The hydraulic dredging apparatus of claim 15 wherein the extendible end section includes a suction mouth, the suction mouth having an overall width which is significantly less than the predetermined distance between the cutting wheels; and positioning means for selectively moving the suction mouth transversely between the rotary cutting wheels to selectively orient the suction mouth adjacent one of the wheels.

18. The hydraulic dredging apparatus of claim 17 wherein the extendible end section includes two suction mouths, one mouth generally facing the one transverse direction, the other mouth generally facing the second transverse direction.

19. A hydraulic dredging apparatus comprising:

a support arm;

a cutting head supported adjacent one end of the support arm, the cutting head comprising:

rotary ripping means for removing material from a face of material, the rotary ripping means being mounted for rotation about a cutting axis, the rotary ripping means comprising at least two rotary cutting wheels transversely spaced from one another a predetermined distance along the cutting axis and thereby defining a space between the wheels, each cutting wheel comprising a plurality of projecting teeth configured relative to one another to enable removed material of a predetermined size to pass to the space between the wheels, the teeth of one wheel being oriented for cutting primarily in one generally transverse direction as the cutting wheels are caused to rotate and be axially moved in the one generally transverse direction;

power drive means for rotationally driving the rotary ripping means;

suction means positioned in the space between the two rotary cutting wheels for hydraulically transporting removed material away from the cutting head, the suction means including a suction mouth, the suction mouth having an overall width which is significantly less than the predetermined distance between the cutting wheels, the suction mouth being mounted for physical movement between the rotary cutting wheels;

adjustment means for moving the suction means substantially perpendicular relative to the cutting axis to maintain the suction means in close proximity to the face of material as the cutting head is moved elevationally relative to the face of material; and positioning means for selectively moving the suction mouth transversely between the rotary cutting wheels to selectively orient the suction mouth adjacent one of the wheels.

20. The hydraulic dredging apparatus of claim 19 wherein the suction means includes two suction mouths, one mouth generally facing the one transverse direction, the other mouth generally facing the second transverse direction.

* * * * *